US005166696A

United States Patent [19]

Rupp et al.

[11] Patent Number: 5,166,696

[45] Date of Patent: Nov. 24, 1992

[54] APPARATUS AND METHOD FOR DEPLOYING AN INFLATABLE ANTENNA

[75] Inventors: Richard B. Rupp, Lockport; Richard J. Blum, Buffalo, both of N.Y.

[73] Assignee: LTV Aerospace and Defense Co., Dallas, Tex.

[21] Appl. No.: 615,961

[22] Filed: Nov. 20, 1990

[51] Int. Cl.[5] ..... H01Q 1/320; H01Q 1/080

[52] U.S. Cl. ..... 343/711; 343/881; 343/899

[58] Field of Search ..... 343/711, 713, 720, 899, 343/878, 879, 880-883, 915, DIG. 2, 714, 716

[56] References Cited

U.S. PATENT DOCUMENTS

| | | | |
|---|---|---|---|
| 3,409,892 | 11/1968 | Mooney, Jr. | 343/713 |
| 4,185,288 | 1/1980 | Dosch et al. | 343/713 |
| 4,587,777 | 5/1986 | Vasqus et al. | 343/880 |
| 4,649,675 | 3/1987 | Moldovan et al. | 343/878 |
| 4,771,293 | 9/1988 | Williams et al. | 343/881 |

*Primary Examiner*—Rolf Hille
*Assistant Examiner*—Peter Toby Brown
*Attorney, Agent, or Firm*—Brooks & Kushman

[57] ABSTRACT

Provided is a method and apparatus for deploying an inflatable antenna from a compressed storage position on the trailer bed of a transport vehicle. A support structure is provided having a pair of spaced apart actuating rails for engagement with the antenna during deployment and a storage compartment stored on the trailer bed of the transport vehicle. The storage compartment is formed of a base wall which is pivotally affixed to both the trailer bed and one end of the compressed antenna, and a deployment structure affixed to the opposing end of the compressed antenna. The deployment structure is partitioned lengthwise to form first and second shelter compartments which are hinged together at one end and pivotable with respect to one another between a closed storage position and an open A-frame position. The shelter compartments further have engaging means for engagement with the support structure actuating rails when opened to the A-frame position to pull the deployment structure and the compressed antenna away from the base wall while inflating the compressed antenna. In operation, the base wall and the deployment structure are elevated from the trailer bed and the deployment structure is disengaged from the base wall. Thereafter, the deployment structure is positioned on the support structure and the shelter compartments are pivoted about their hinged axis and secured in an open cantilevered position. The shelter compartments are thereafter engaged with the support structure and pulled away from the base wall while the antenna is inflated.

10 Claims, 6 Drawing Sheets

APPARATUS AND METHOD FOR DEPLOYING AN INFLATABLE ANTENNA

TECHNICAL FIELD

This invention relates to antenna deployment systems, and more particularly, to an apparatus and method for deploying an inflatable antenna.

BACKGROUND ART

Inflatable structures have been effectively used to suspend and support radar reflectors and antennas in various environments. One commonly used type of inflatable structure is an inflatable radar reflector incorporated within a life raft. For example, see U.S. Pat. No. 3,130,406 issued to Jones-Hinton. Each of the several embodiments illustrated in the '406 patent comprise a circular sheet of flexible material having at least one circular central section reflective of radio waves and an inflatable endless tube which encircles the sheet to hold the center section taut and flat when the tube is inflated.

Similarly, see U.S. Pat. No. 4,475,109 issued to Dumas discloses an inflatable antenna for use with a buoy at sea. The Dumas antenna comprises a closed inflatable compartment having a top section coated with conductive material in selected areas on the inside of the compartment to form capacitive loading portions. There is further disclosed flexible webs in the inflatable compartments which are selectively coated with conductive material to provide the vertical blade for each radiating element. As disclosed by Dumas, the radiating elements of the antenna are formed by conductive metalized portions of the antenna fabric.

Inflatable antennas have also been used to support radar antennas and reflectors for radio waves. See, for example U.S. Pat. No. 2,913,726 issued to Curry. The Curry patent discloses an inflatable antenna assembly comprising a pair of paraboloids joined at their rims to form an inflatable housing supported in an upright position on a rotatable base. As disclosed by Curry, one of the paraboloids has its inner surface coated with reflective material so that when the housing is inflated, the coated paraboloid assumes the configuration of a parabolic antenna reflector. Curry also discloses a radome for the inflatable antenna comprising a spherical structure of neoprene-coated nylon to be mounted and inflated directly on the ground.

U.S. Pat. No. 3,005,987 issued to Mack discloses an inflatable antenna assembly comprising an elliptical tubular member having sheets of flexible nonconducting material fastened to opposite sides of the tube to form an enclosure.

U.S. Pat. No. 3,115,631 issued to Martin discloses an inflatable reflector for radio waves comprising a base of double pile textile fabric having outer sheets which are rendered substantially impermeable to gas and are tied together in a parallel-spaced relation by pile threads. The threads are woven through the fabric and form a chamber which can be inflated. Upon inflation, sheets of flexible radio reflecting material which are secured therein become taut and held flat in a mutually perpendicular relation.

U.S. Pat. No. 3,170,471 issued to Schnitzer discloses an inflatable honey-comb element for use in making up structures which are foldable and inflatable. The element comprises a collapsible, inflatable structure which has flexible outer skin members and flexible inner core members which are perpendicularly disposed to divide the element into a plurality of cells. The panel structure may be fabricated of a thin, lightweight flexible plastic film or sheet which may further have a thin layer of metal placed thereon to strengthen the plastic and to reflect the light and radio wave.

Finally, U.S. Pat. No. 3,176,302 issued to Tipton discloses an inflatable variable bandwidth antenna having an inflatable tubular ring which supports a flexible diaphragm. The diaphragm comprises nonconductive fabric and parallel, spaced elastic flexible conductive strips secured by their ends to the periphery of the housing.

While each of the above structures are lightweight and inflatable, they are of varying complexity and for the most part are difficult to deploy and dismantle.

DISCLOSURE OF THE INVENTION

In accordance with the present invention, there is provided an apparatus and method for deploying an inflatable antenna from a compressed storage position on the bed of a transport vehicle onto a support structure, including the transport vehicle bed itself.

The apparatus of the present invention comprises a storage compartment formed in part of a base wall which is pivotably affixed on one end to the bed of the transport vehicle and further affixed on the other end to the compressed antenna. The storage compartment further comprises a deployment structure affixed to the opposing end of the compressed antenna which is partitioned lengthwise to form first and second shelter compartments. These shelter compartments are hinged together at one end and pivotable with respect to one another between a closed storage position and an open A-frame position. The present invention further provides for the incorporation of actuating rails within the support structure for engagement with lugs or other engaging means affixed to the shelter sections to engage the shelter sections during deployment.

In operation, the base wall and the deployment structure are first elevated from substantially horizontal deployment positions on the bed of the transport vehicle to substantially vertical deployment positions by elevating means such as a hydraulic cylinder. Thereafter, the deployment structure is disengaged from the base wall and positioned on the support structure. The deployment structure shelter compartments are then pivoted about their hinged axis and are secured by a spreader bar or other locking device in an open cantilevered position. The shelter compartments are then engaged with the base structure actuating rails. Finally, the deployment wall and the compressed antenna are pulled along the support structure away from the base wall while being inflated and secured.

In a first embodiment of the invention, there is disclosed a portable support structure having spaced apart actuating rails for engagement with the antenna during deployment.

In a second embodiment, the support structure is disclosed as the transport vehicle bed itself having side walls pivotably affixed to its opposing sides. As disclosed by applicants, the side walls may be rotated from closed storage positions to open support positions to form a single enlarged support structure. The side walls are further provided with spaced apart actuating rails and adjustable height mounting pads to level and stabilize the entire support structure.

In a third embodiment, the support structure is disclosed as being formed by the transport vehicle bed and an extension structure having a deployment end and a pivot end pivotably affixed to one end of the transport vehicle bed. As disclosed by applicants, the extension structure may be rotated from a closed storage position to an open support position to extend the length of the overall support structure. The bed and the extension structure are further provided with pairs of side walls pivotably affixed to opposing sides of the bed and extension structure, respectively, which may be rotated from closed storage positions to open support positions to form a single enlarged support structure. Again, the side walls are provided with spaced apart actuating rails and adjustable height mounting pads to level and stabilize the support structure.

In operation, the base wall and the deployment structure are elevated from substantially horizontal transport positions to substantially vertical deployment positions on the desired support structure. The deployment structure is thereafter disengaged from the base wall and positioned on the support structure. Next, the deployment structure shelter compartments are pivoted about their hinged axis and secured in an open cantilevered position by means of a spreader bar or similar locking device. The shelter compartments are then engaged with the respective support structure and the compressed antenna is pulled away from the base wall along with the deployment structure while being inflated.

Accordingly, it is an object of the present invention to provide an apparatus and method for quickly and easily deploying an inflatable antenna from a compressed non-inflated position on the bed of a transport vehicle to an inflated, operational position while being protected from inclement weather.

BRIEF DESCRIPTION OF THE DRAWINGS

The present invention can be more completely understood by reference to the accompanying drawings in which.

BEST MODE FOR CARRYING OUT THE INVENTION

Figure 1:
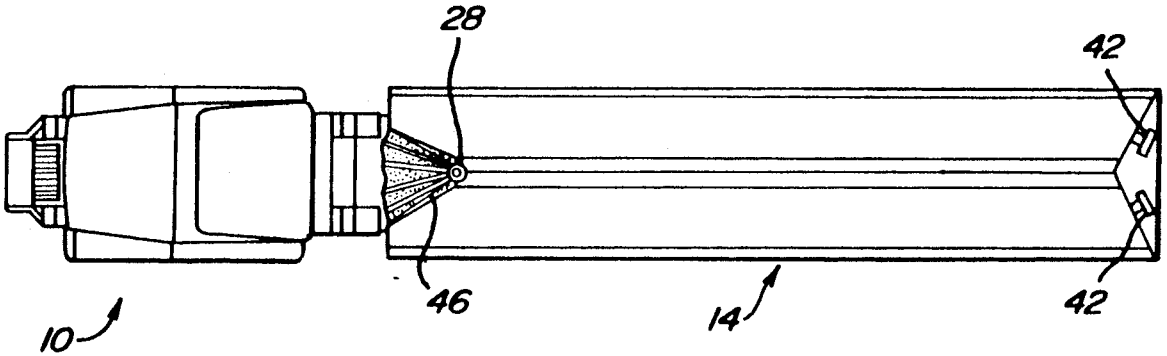
FIG. 1 is a plan view of the transport vehicle having as its load the antenna deployment apparatus illustrating a first embodiment of the present invention.
Figure 2:
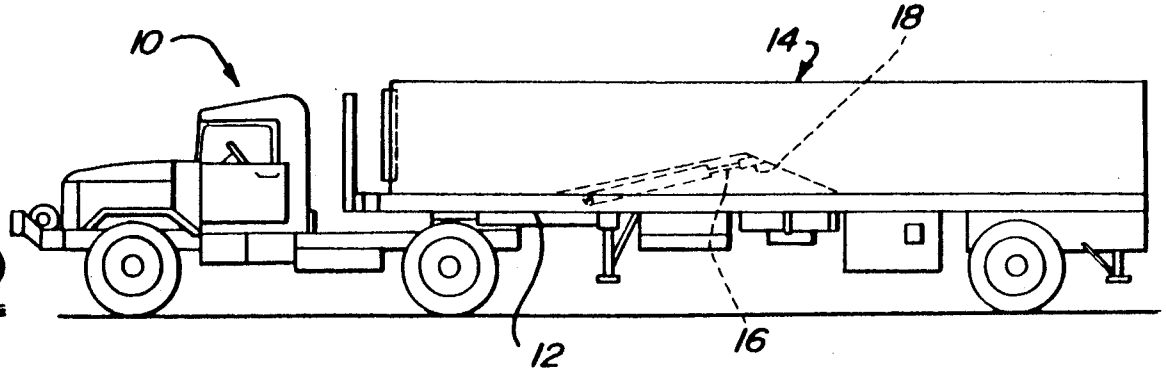
FIG. 2 is a side elevational view of the transport vehicle of FIG. 1 with the means for elevating the antenna storage compartment to its deployment position shown in dotted outline.
Figure 3:
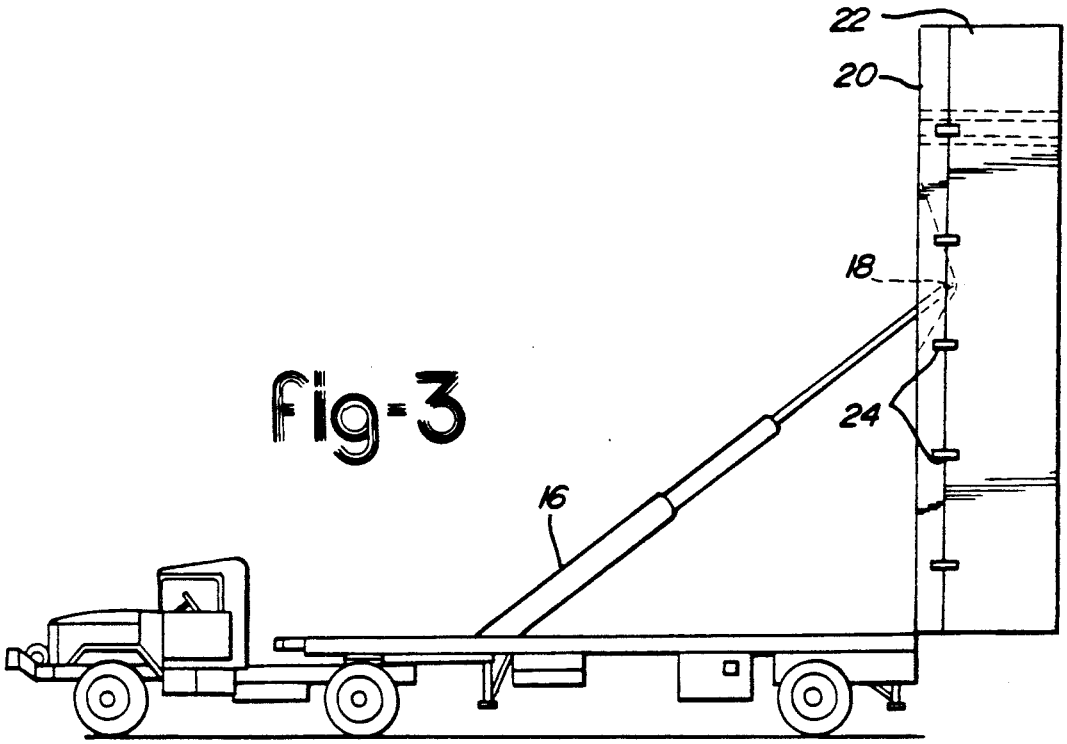
FIG. 3 is a side elevational view of the transport vehicle of FIG. 1 with the storage compartment elevated to the vertical closed position.
Figure 4:
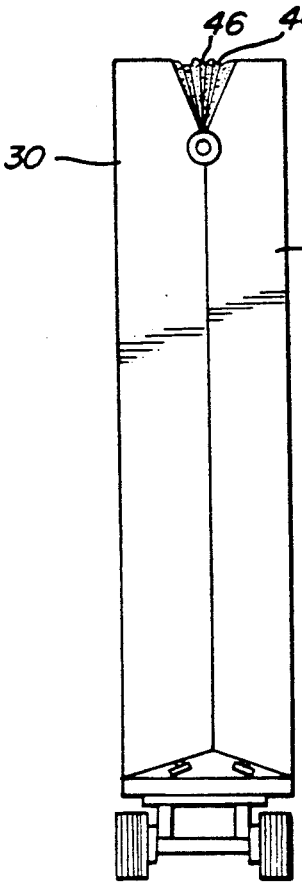
FIG. 4 is a rear elevational view of the transport vehicle shown in FIG. 3.
Figure 5:
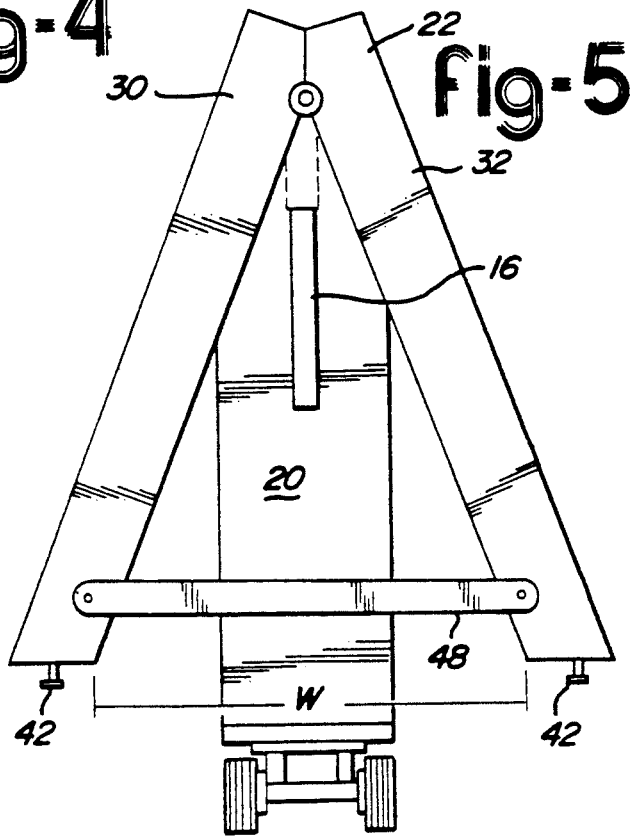
FIG. 5 is a rear elevational view of the transport vehicle of FIG. 1 with the shelter compartment opened to a deployment position.

With reference to FIGS. 1–5 of the drawings, a transport vehicle indicated generally by reference numeral 10 is shown having a bed 12 and a storage compartment 14 pivotably affixed thereon for deployment of a compressed inflatable accordion fold antenna. FIGS. 2–3 further disclose means for elevating the support structure from a substantially horizontal storage position to a substantially vertical deployment position such as a hydraulic cylinder 16 extending between the base plate 18 on the storage compartment 14 and the transport vehicle bed 12.

Storage compartment 14 forms a sealed container eight feet wide by eight feet high and thirty feet long to store an eighty foot long antenna compressed to eight feet. In turn, the storage compartment is formed of two sections, each four feet wide and affixed to one another about a common hinge. The thirty foot length is necessary so that the fabric is folded only in one plane. It is recognized that a shorter or longer container may be used if the size of the antenna is varied.

In accordance with the present invention, the storage compartment 14 disclosed is formed of a base wall 20 and a deployment structure 22 which is secured to the base wall during storage by latches 24 or other securing means. As set forth above, inflatable antenna 26 is stored in a non-inflated, compressed position within the storage compartment 14. The compressed antenna 26 is further affixed at one end to the base wall 20 and at the opposing end to the deployment structure 22.

Figure 8:
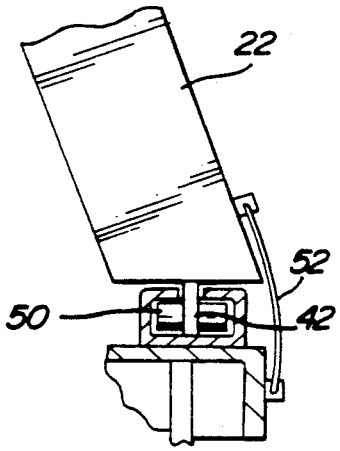
FIG. 8 is a sectional view of the antenna taken along lines 8—8 of FIG. 7.

Referring still to FIGS. 1–5, it is seen that deployment structure 22 contains a hinge on one end 28 and is partitioned lengthwise to form first and second shelter compartments 30 and 32, respectively. Each compartment is designed to contain a complete planar array dipole antenna which, upon erection, forms one side of the A-frame antenna structure. Shelter compartments 30 and 32 further contain engaging means such as lugs 42 for engagement with the base structure during deployment. As shown in FIG. 8, actuating rails 40 may also contain captive dollies 50 for engagement with lugs 42.

Figure 6:
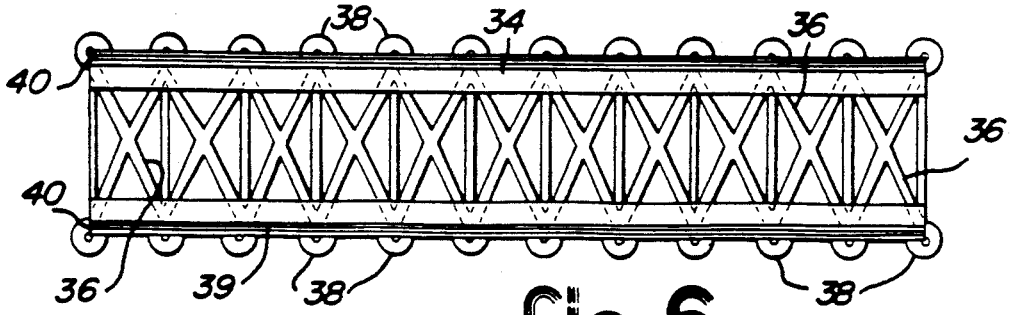
FIG. 6 is a plan view of a portable support structure for use with the antenna apparatus of FIG. 1.

With reference to FIG. 6, a first embodiment of a support structure for deployment of the inflatable antenna is shown as a portable structure 34 comprised of prefabricated eight foot by twenty foot sections 36 having adjustable height mounting pads 38. Eleven sections are assembled to form a base that is eight-eight feet in length by twenty feet in width. The first section to be deployed has four adjustable height mounting pads 38. Each subsequent section is joined to the preceding section along one twenty foot side, and has two adjustable pads on the opposing side. Smooth four foot wide surfaces of rigid sheet metal 39 may also be provided along the outside edges to provide a supporting surface for the ends of the inflated antenna. Support structure 34 further contains spaced apart actuating rails 40 for engagement with the antenna during deployment. Lugs 42 may further be affixed to the ends of shelter compartments 30 and 32, respectively, as a means for engagement with actuating rails 40. The above physical dimensions are for descriptive purpose only, and illustrate the large size which can be deployed in a practical manner.

Referring again to FIGS. 1–5, shelter compartments 30 and 32 are notched about their hinge shown generally by reference numeral 44 to permit the compartments to open to a cantilevered position having a predetermined base width W. Notch 44 is filled with a resilient material 46 such as a grommet, to prevent foreign objects from lodging between the shelter compartments during deployment and storage. There is further provided a detachable spreader bar 48 or other locking device between the shelter sections 30 and 32 to secure the compartment in an open cantilevered position and provide a mechanically rigid structure.

As set forth herein, the selected antenna for deployment is an A-frame inflatable accordion fold antenna. The fold permits the antenna to be deployed similar to a shower curtain. To deploy the antenna, storage compartment 14 is tipped on end to a substantially vertical deployment position on the transport vehicle bed from a substantially horizontal storage position. The deployment structure 22 and base wall 20 are then disengaged from each other and the deployment structure is positioned on the support structure.

Shelter compartments 30 and 32 are then opened in a clam shell fashion about their hinged axis and spreader bar 48 is affixed between the shelter sections to secure the compartments in an open cantilevered position and provide mechanically rigid support. Shelter compartments 30 and 32 are then positioned on the support structure and lugs 42 are mated with captive dollies 50 of the actuating rails 40. Winch cables or other actuators are then used to pull the dollies and their antenna load away from the flat bed to deploy the antenna. The antenna fabric feeds out of the shelter sections as it proceeds down the base structure; this prevents dragging the antenna fabric along the structure.

Figure 7:
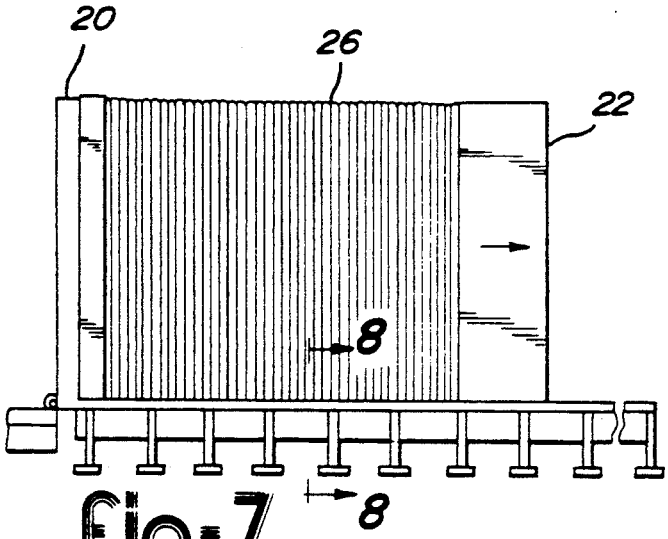
FIG. 7 is a side elevational view of the antenna apparatus of FIG. 1 being deployed on the support structure of FIG. 6.
Figure 9:
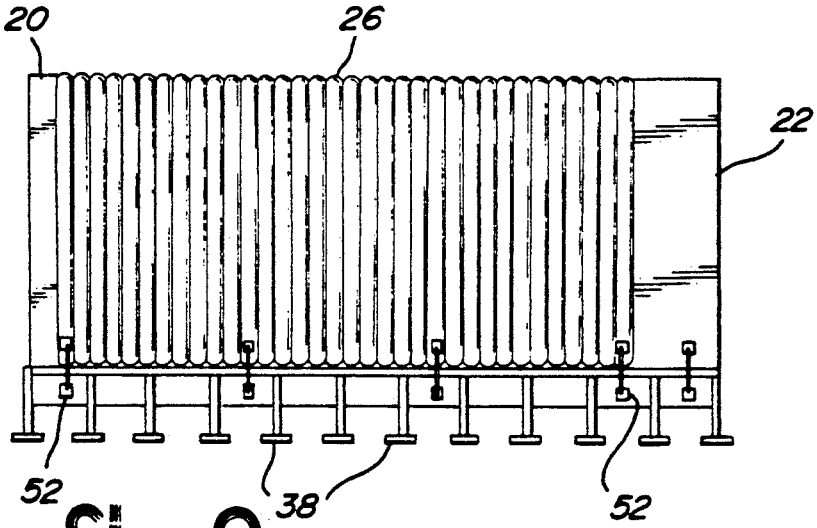
FIG. 9 is a side elevational view of the first antenna embodiment in an inflated and secured position.
Figure 10:
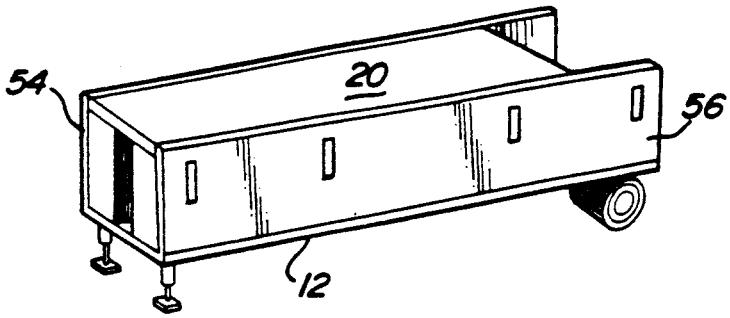
FIG. 10 is a perspective view of a second embodiment of the invention.
Figure 11:
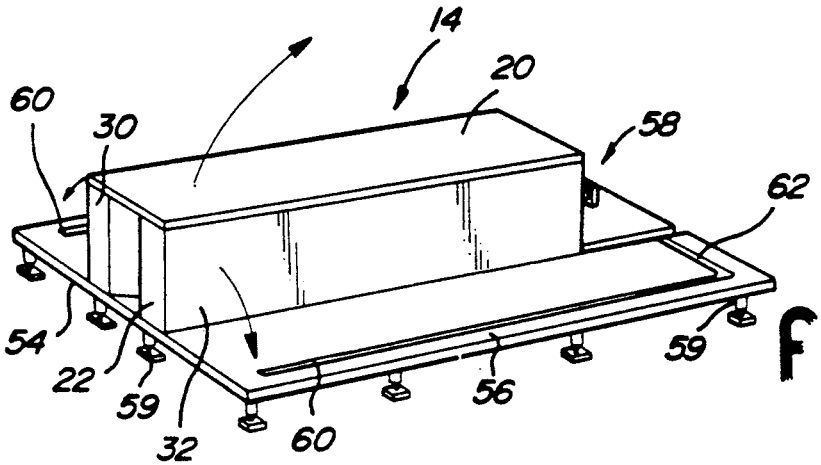
FIG. 11 is a perspective view of the antenna apparatus of FIG. 10 shown with its side walls in an open position.
Figure 12:
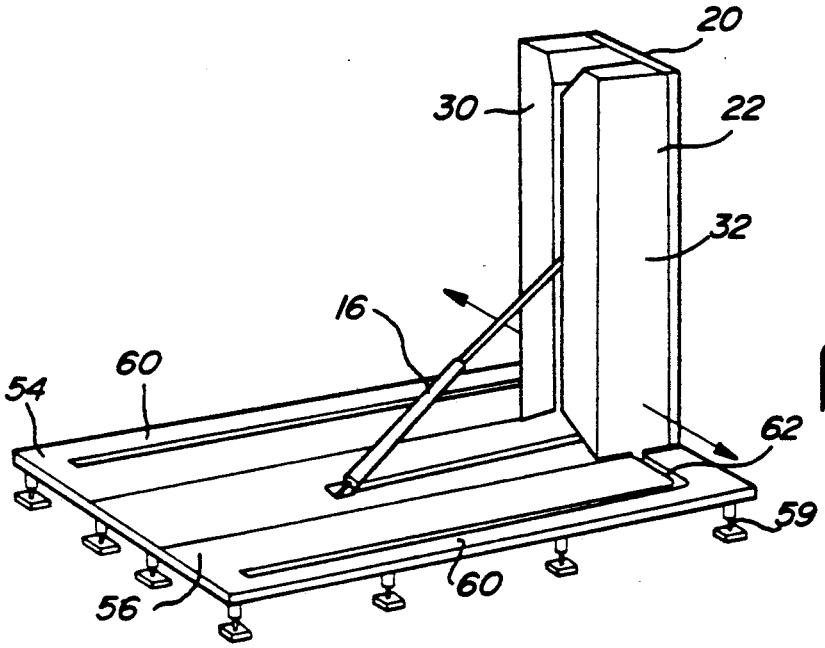
FIG. 12 is a perspective of the antenna apparatus of FIG. 11 shown with the storage compartment in a vertical closed position.
Figure 13:
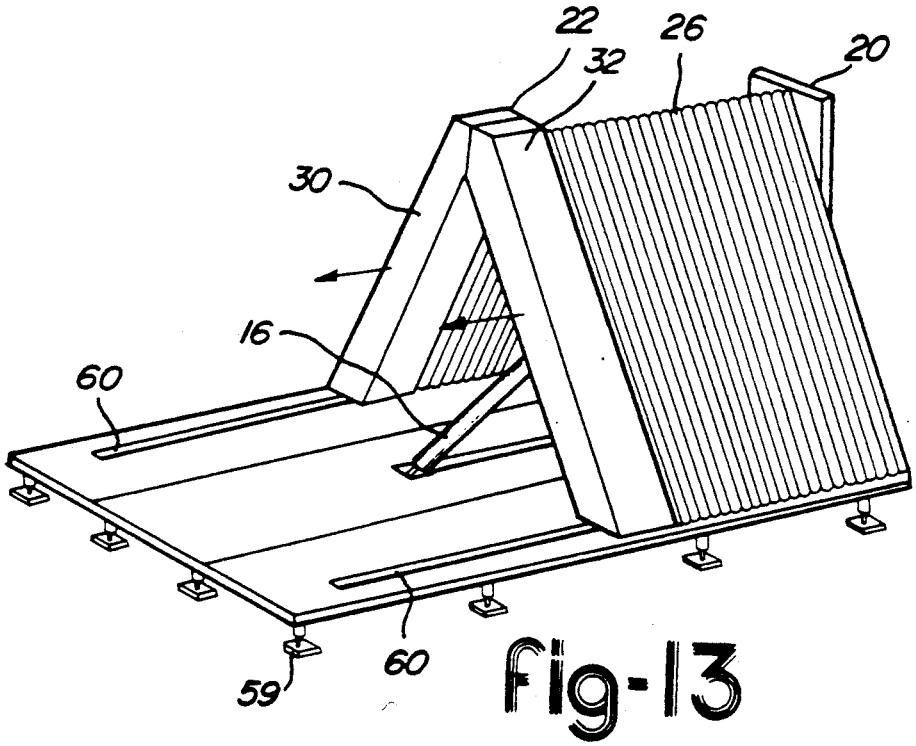
FIG. 13 is a perspective view of the antenna apparatus of FIGS. 10–12 shown with its antenna load partially deployed.
Figure 14:
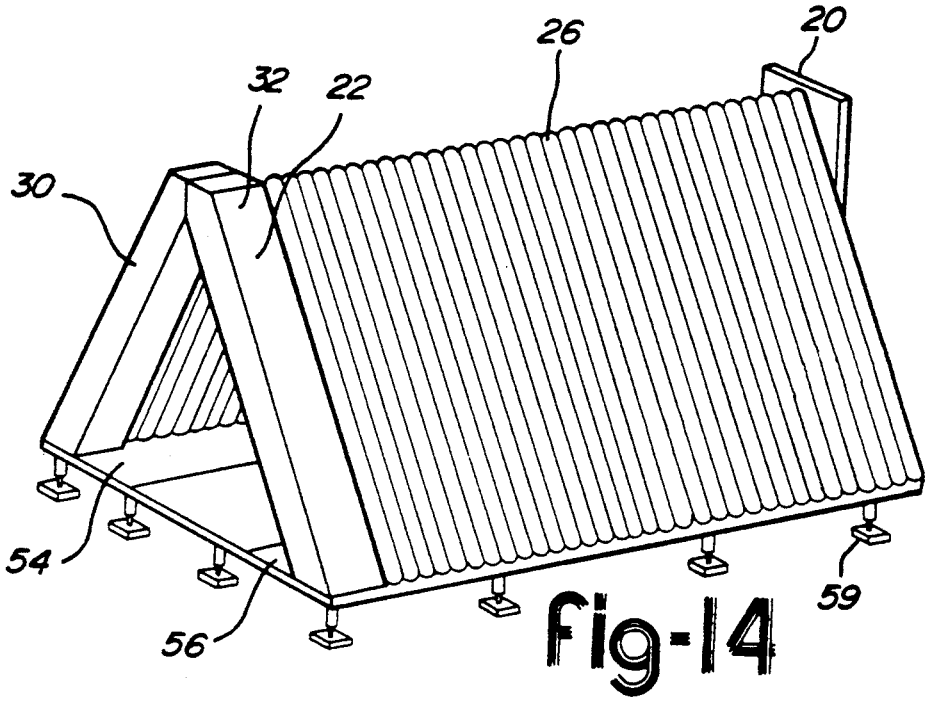
FIG. 14 is a perspective view of the antenna apparatus of FIGS. 10–13 in the fully deployed position.

As shown in FIGS. 7–9, antenna 26 may be inflated in sections and tied down by straps 52 or other securing means as the shelter sections are pulled along the support structure. This section-by-section inflation and tie-down makes deployment possible during substantial wind conditions and other inclement weather. Upon completion of the deployment and inflation of the antenna, the deployment structure is then secured to the support structure.

In a second embodiment of the invention shown in FIGS. 10–14, the deployment apparatus of the invention is disclosed to utilize the transport vehicle bed 12 as the sole support structure. There is further disclosed side walls 54 and 56 pivotably affixed to opposing sides of the transport vehicle bed. Side walls 54 and 56 may be rotated from closed storage positions to open support positions to form an enlarged support structure. The enlarged structure is generally referred to by reference numeral 58 and contains adjustable height mounting pads 59 to properly level and stabilize the structure.

In this embodiment, spaced apart actuating rails 60 are disclosed to be placed in side walls 54 and 56 for engagement with lugs 42 of shelter sections 30 and 32 during deployment. There is further disclosed actuating rails 62 for engagement with lugs 42 while being initially opened to the cantilevered position.

In operation, deployment of this preferred embodiment is achieved in much the same way as the first embodiment set forth above. Namely, side walls 54 and 56 are first rotated from closed storage positions to open support positions and thereafter leveled and stabilized by height mounting pads 59. Storage compartment 14 is then tipped on end to a substantially vertical deployment position on the transport vehicle bed from a substantially horizontal storage position. Deployment structure 22 and base wall 20 are then disengaged from each other as lugs 42 are engaged with actuating rails 62.

The storage compartment 14 is then opened. As shelter sections 30 and 32 are opened in a clam-shell fashion about their hinged axis, a spreader bar 48 or other locking device may be affixed between the shelter sections to secure the compartments in their open cantilevered position. Lugs 42 of shelter sections 30 and 32 are then mated with captive dollies 50 contained within the actuating rails 60 of side walls 54 and 56.

Winch cables or other actuators are then used to pull the dollies and their antenna load away from the base wall and along the transport vehicle bed. As the deployment structure is pulled along the transport vehicle bed, the antenna fabric is fed out of the shelter sections and inflated and secured. Upon completion of the deployment and inflation of the antenna, the deployment structure is secured to the support structure.

Figure 15:
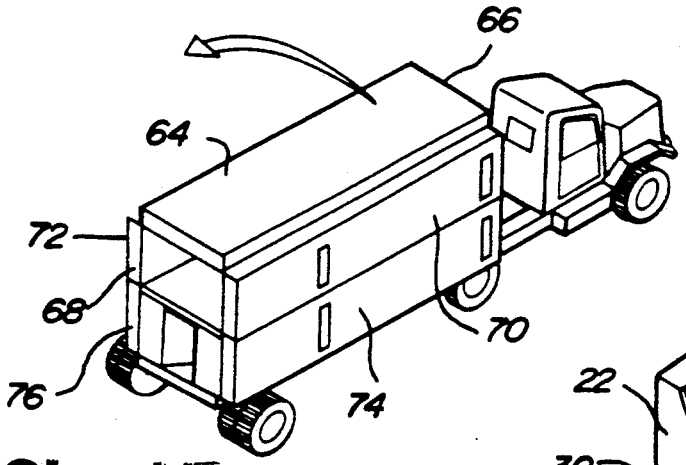
FIG. 15 is a perspective view of a third embodiment of the invention in the transport position.
Figure 16:
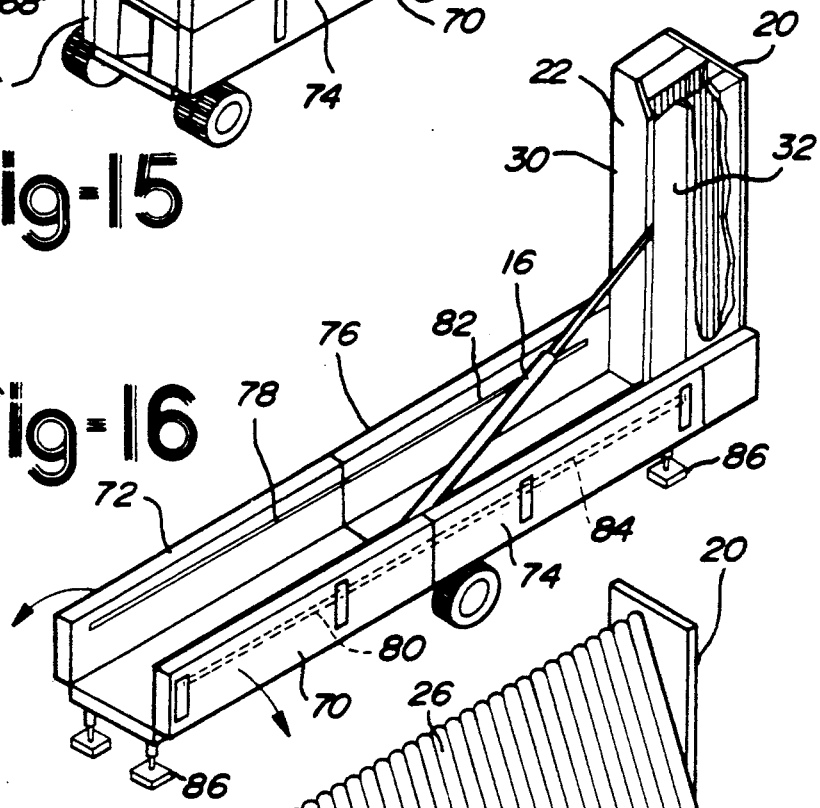
FIG. 16 is a perspective view of the antenna apparatus of FIG. 15 shown in the partially deployed position.
Figure 17:
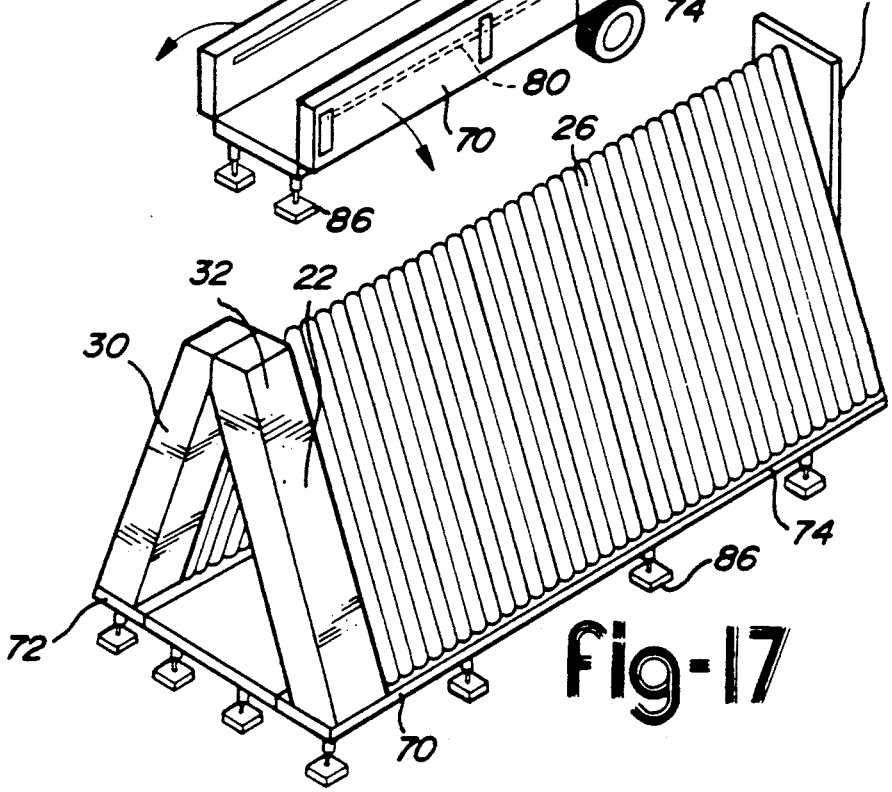
FIG. 17 is a perspective of the antenna apparatus of FIGS. 15–16 shown fully deployed.

In a third embodiment shown in FIGS. 15–17, there is disclosed an extension structure 64 having a deployment end 66 and a pivot end 68 pivotally affixed to one end of the transport vehicle bed 12 for rotation from a closed storage position to an open storage position. It is anticipated that the extension structure may have to be rotated up to one hundred eighty degrees to properly support the antenna apparatus of the invention.

The transport vehicle bed 12 and extension structure 64 are further provided with side walls 70 and 72, and 74 and 76, respectively, which may also be rotated from closed storage positions to open support positions to form an enlarged support structure. There is further provided spaced apart actuating rails 78 and 80 affixed to side walls 70 and 72 and actuating rails 82 and 84 affixed to side walls 74 and 76 for engagement with the shelter sections 30 and 32 during deployment. Transport vehicle bed 12, extension structure 64 and each of the respective side walls 70, 72, 74, and 76 are further provided with adjustable height mounting pads 86 for leveling and stabilizing the entire support structure.

In operation, extension structure 64 is first rotated from its closed storage position to an open support position. Side walls 70, 72, 74 and 76 are then rotated from closed storage positions to open support positions and thereafter leveled and stabilized by height mounting pads 86. Storage compartment 14 is then tipped on end to a substantially vertical deployment position on the transport vehicle bed from a substantially horizontal storage position. Thereafter, deployment structure 22 and base wall 20 are disengaged from each other as shelter compartments 30 and 32 are mated with additional actuating rails 88 and opened in a clam-shell fashion about their hinged axis. A spreader bar 48 or other locking device may be affixed between the shelter compartments to secure the compartments in an opened cantilevered position and provide mechanical support.

Shelter compartments 30 and 32 are then positioned within actuating rails 78, 80, 82 and 84 of side walls 70, 72, 74 and 76, respectively, and the antenna load is pulled away from the base wall to deploy the antenna. Again, the antenna is inflated and tied down by straps so that deployment is possible during substantial wind conditions. Upon completion of the deployment and inflation of the antenna, the deployment wall is secured to the support structure.

While the best modes for carrying out the invention have been described in detail, those familiar with the art to which this invention relates will recognize alternative designs and embodiments for practicing the invention as defined by the following claims.

What is claimed is:

1. An apparatus for deploying an inflatable antenna from a compressed storage position on the bed of a transport vehicle, comprising:

a portable support structure having a pair of spaced apart actuating rails; and a storage compartment for storing the inflatable antenna in the compressed storage position, said storage compartment having a base wall pivotally affixed to the transport vehicle bed and a deployment structure displaceable relative to said base wall, the inflatable antenna having a first end affixed to said base wall and an opposing second end affixed to said deployment structure, said deployment structure partitioned lengthwise to form first and second shelter compartments, said first and second shelter compartments each having a first end and a second end, said first end of said first and second shelter compartments are pivotably connected to each other, said first and second shelter compartments are pivotable with respect to one another between a closed storage position and an open A-frame position, each of said first and second shelter compartments further having means disposed at said second end for engaging said spaced apart actuating rails when opened to said A-frame position, said spaced apart actuating rails guiding the displacement of said deployment structure and the end of the inflatable antenna affixed to the deployment structure away from said base wall.

2. The apparatus of claim 1, wherein said base wall is pivotably connected to the bed of the transport vehicle and is pivotable between a substantially horizontal storage position and a vertical position.

3. The apparatus as in claim 1, wherein said deployment structure is releasably affixed to said base wall.

4. An apparatus as in claim 1, wherein said support structure actuating rails having captive dollies.

5. The apparatus as in claim 4, wherein said means for engaging comprises lugs affixed to the bottom of said first and second shelter compartments which engage said captive dollies.

6. The apparatus as in claim 1, wherein the support structure is comprised of pre-fabricated sections having adjustable height mounting pads.

7. The apparatus as in claim 1, wherein said first and second shelter compartments are pivotably connected by a hinge to permit the compartments to open to said A frame position having a predetermined base width.

8. The apparatus as in claim 7, wherein said first and second shelter compartments have a notch to facilitate the first and second shelter compartments to be opened and wherein said notch is filled with a resilient material to prevent foreign objects from lodging between said first and second shelter compartments.

9. A method of deploying an inflatable antenna on a support structure from a compressed storage position on the bed of a transport vehicle, comprising the steps of:

providing a plurality of actuating rials on the support structure;

providing a storage compartment for storing said inflatable antenna in the compressed position, said storage compartment having a base wall pivotably affixed to the bed of the transport vehicle, and a deployment structure, the inflatable antenna having a first end affixed to said base wall and a second end affixed to said deployment structure, said deployment structure partitioned lengthwise to form first and second shelter compartments, said first and second shelter compartments each having a first end and a second end, said first end of said first and second shelter compartments are pivotably connected to each other and the first and second shelter compartments are pivotable with respect to one another between a closed storage position and an open A-frame position, said first and second shelter compartments further having means provided at said second end for engaging said actuating rails;

elevating said base wall and said deployment structure from transport positions to deployment positions on the bed of said transport vehicle;

disengaging said deployment structure from said base wall;

pivoting said first and second shelter compartments of said deployment structure about said pivotably connected ends to said open A-frame position; and engaging said means for engaging with said actuating rails, said actuating rails guiding the displacement of said deployment structure relative to the base wall to extend said inflatable antenna from said compressed position to an extended position.

10. A method as in claim 9 wherein said step of elevating includes the step of elevating said base wall and said deployment structure from substantially horizontal transport positions to substantially vertical deployment positions on the bed of the transport vehicle.

* * * * *

UNITED STATES PATENT AND TRADEMARK OFFICE

CERTIFICATE OF CORRECTION

PATENT NO. : 5,166,696
DATED : November 24, 1992
INVENTOR(S) : Richard B. Rupp, et al.

It is certified that error appears in the above-indentified patent and that said Letters Patent is hereby corrected as shown below:

Column 4, line 68, delete "eight-eight" and insert --eighty-eight--.

Column 8, line 20, delete "rials" and insert --rails--.

Signed and Sealed this

Ninth Day of August, 1994

*Attest:*

Bruce Lehman

BRUCE LEHMAN

*Attesting Officer*

*Commissioner of Patents and Trademarks*